United States Patent [19]

Moors

[11] Patent Number: 4,550,963

[45] Date of Patent: Nov. 5, 1985

[54] ELECTRICAL CONNECTOR

[75] Inventor: Johannes H. Moors, Eindhoven, Netherlands

[73] Assignee: U.S. Philips Corporation, New York, N.Y.

[21] Appl. No.: 504,550

[22] Filed: Jun. 15, 1983

[30] Foreign Application Priority Data

Jul. 2, 1982 [NL] Netherlands ..... 8202668

[51] Int. Cl.[4] ..... H01R 13/20; H01R 13/11

[52] U.S. Cl. ..... 339/31 R; 339/65; 339/74 R; 339/256 SP; 339/258 S

[58] Field of Search ..... 339/31 R, 65, 74 R, 339/80, 256 SP, 258 F, 258 S

[56] References Cited

U.S. PATENT DOCUMENTS

| | | | |
|---|---|---|---|
| Re. 31,142 | 2/1983 | Simmons | 339/74 R |
| 2,600,190 | 6/1952 | Batcheller | 339/256 SP |
| 3,550,069 | 10/1970 | Teagno | 339/256 SP |
| 3,976,348 | 8/1976 | Simmons | 339/258 S X |
| 4,181,390 | 1/1980 | Aizawa | 339/65 |

FOREIGN PATENT DOCUMENTS

| | | | |
|---|---|---|---|
| 43655 | 1/1982 | European Pat. Off. | 339/74 R |

*Primary Examiner*—Gil Weidenfeld
*Assistant Examiner*—Steven C. Bishop
*Attorney, Agent, or Firm*—Robert J. Kraus

[57] ABSTRACT

The connector which is formed from sheet material comprises a receptacle portion (1') with a base (11') and a pair of upstanding side walls (13') with turned-in edge portions (15'). The receptacle portion (1') is suitable to receive a flat tab male terminal (5') from a front end and comprises a resilient tongue (21') which is released from the base (11') and which extends rearwardly from the front of the base and comprises a projection (25') which is capable of cooperating with a cut-out (27') formed in the terminal (5') in order to secure the terminal (5') in the receptacle. At the area of the side edges (33') of the resilient tongue (21') first tags (37) are released from the base (11') so that the connector can be made suitable to receive flat male tab terminals of different widths by performing only a simple finishing operation. For wide terminals the first tags (37) are completely removed from the base (11'), while for narrow terminals they are bent upward from the base so that they extend approximately parallel to the side walls (13').

3 Claims, 8 Drawing Figures

ELECTRICAL CONNECTOR

BACKGROUND OF THE INVENTION

The invention relates to an electrical connector which is formed from sheet material and which comprises a receptacle portion comprising a base and a pair of upstanding side walls, free edge portions thereof being turned in towards the base. The receptable portion is suitable to receive a flat tab male terminal from a front end. A resilient tongue which is released from the base extends rearwardly from its root at the front end of the base. The tongue has a projection which can cooperate with a cut-out formed in the flat tab male terminal in order to lock this terminal.

A connector of this kind is known, for example, from European patent application No. 43,655. It can be simply formed from sheet material by stamping and bending; during this operation the resilient tongue is also released from the base by stamping. In the known connector the passage for the flat tab male terminal to be received is bounded by the base, the upstanding side walls and the turned-in edge portions thereof. The width of the flat tab male terminal which can be received by the connector, therefore, substantially equals the distance between the two side walls. Consequently, when connectors for flat tab male terminals having a different width are required, the distance between the side walls of these connectors must be different, so that different stamping and bending tools will be required for their manufacture. Because the shape of the connector is comparatively complex, such tools are expensive.

SUMMARY OF THE INVENTION

It is an object of the invention to provide a connector of the kind set forth which requires only very modest modifications in order to make it suitable to receive flat tab male terminals having different widths, so that its manufacture can be performed substantially by means of one tool, after which only a simple finishing operation is required by means of a simple and inexpensive tool which differs for the different widths.

To this end, the connector in accordance with the invention is characterized in that at the area of the side edges of the resilient tongue first tags are released from the base, at least the free edges of said tags which face the tongue being removed from the immediate vicinity of the tongue.

Depending on how the free edges of the first tags are removed from the immediate vicinity of the tongue, the connector will be suitable to receive wide or narrow flat tab male terminals. An embodiment which is particularly suitable for wide flat tab male terminals is characterized in that the first tags are completely removed from the base in order to form openings in the base. The width of the flat tab male terminal to be received is determined by the distance between the two side walls in this embodiment.

An embodiment which is suitable to receive narrow flat tab male terminals is characterized in that the first tags are turned upward from the base so that they extend approximately parallel to the side walls. The width of the flat tab male terminal to be received is then determined by the distance between the two first tags which is smaller than the distance between the side walls.

A further, improved embodiment of this kind is characterized in that the front end of the base extends beyond the side walls and that second tags are released therefrom, said second tags being turned upwards so that they extend approximately parallel to the side walls and at substantially the same distance from one another as the first tags. The second tags guide the male terminal from the beginning of insertion, so that damaging of the first tags by oblique insertion of the terminal is prevented.

BRIEF DESCRIPTION OF THE DRAWING

The invention will be described in detail hereinafter with reference to the drawing in which.

DESCRIPTION OF THE PREFERRED EMBODIMENTS

Figure 1:
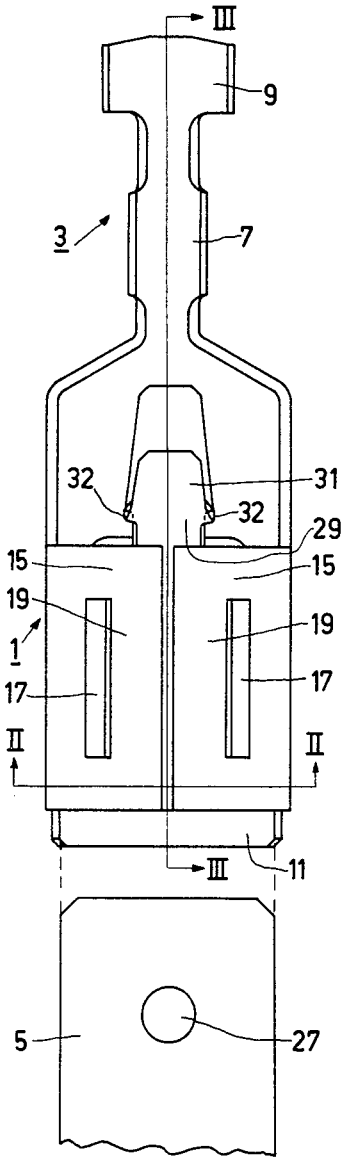
FIG. 1 is a plan view of a first embodiment of a connector in accordance with the invention with a corresponding flat tab male terminal.

The connector shown in FIG. 1 is formed from sheet material and comprises a receptacle portion 1 and a connection portion 3. The receptable portion 1 is arranged to receive a flat tab male terminal 5 having a width of 4.8 mm in the present embodiment. The connection portion 3 comprises a first portion 7 which is bent so as to be trough-shaped and which serves to make a crimp connection with a conductor of an insulated connection wire (not shown) and also comprises a second portion 9 which is also bent so as to be trough-shaped in order to make a crimp connection with the insulation of the connection wire. Connection portions of this kind are known per se.

Figure 2:
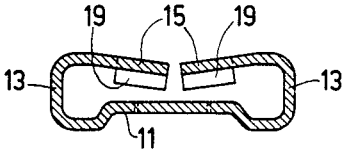
FIG. 2 is a cross-sectional view of the connector shown in FIG. 1.
Figure 5:
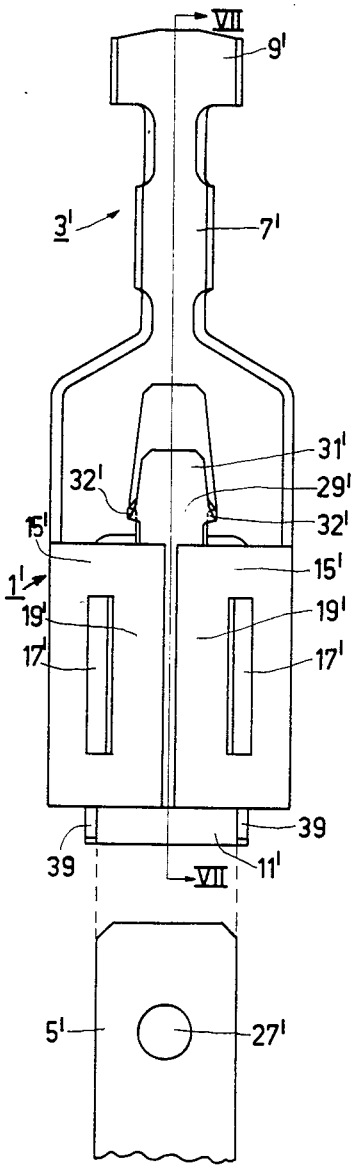
FIG. 5 is a plan view of a second embodiment of a connector in accordance with the invention with a corresponding flat tab male terminal.
Figure 7:
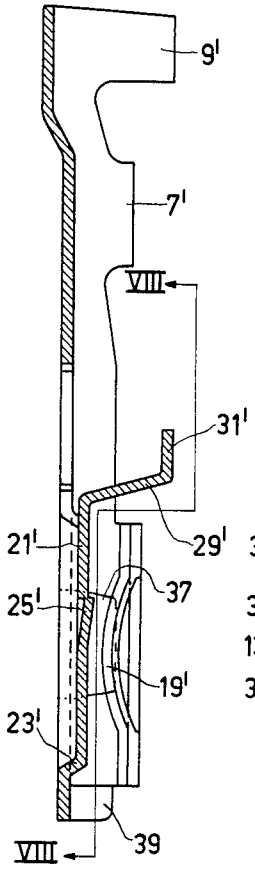
FIG. 7 is a longitudinal sectional view of the connector shown in FIG. 5.
Figure 8:
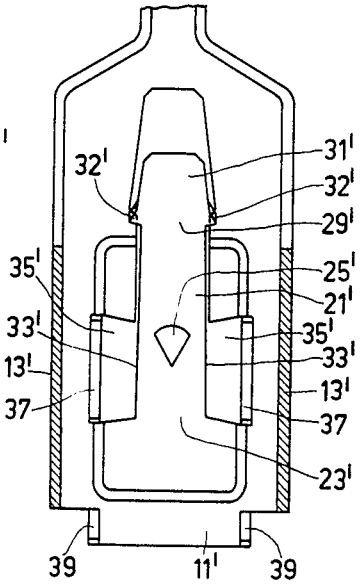
FIG. 8 is partly a plan view and partly a sectional view of the connector shown in FIG. 5.
Figure 6:
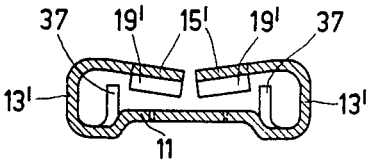
FIG. 6 is a cross-sectional view of the connector shown in FIG. 5.

The receptacle portion comprises a mainly flat base 11 (see also FIG. 2) and a pair of upstanding side walls 13 the free edge portions 15 of which are turned inwards so that they are generally directed toward the base. Elongate openings 17 are stamped in these free edge portions so that the front and the rear portion of each edge portion is interconnected via an arcuate strip 19 which extends in the direction of the base. The width of the space for a flat tab male terminal 5 to be inserted from the front end of the connector (at the bottom in FIG. 1) is limited by the two side walls 13. In the height direction the terminal 5 is clamped between the base at the bottom and the strips 19 at the top.

Figure 3:
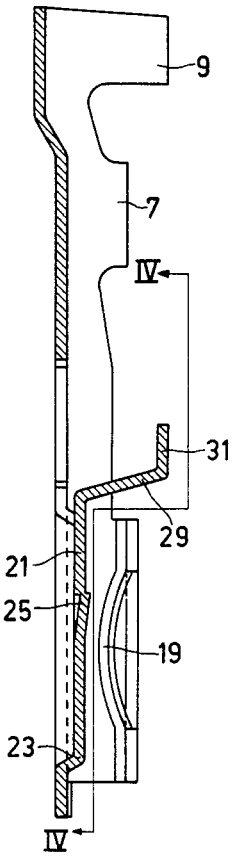
FIG. 3 is a longitudinal sectional view of the connector shown in FIG. 1.
Figure 4:
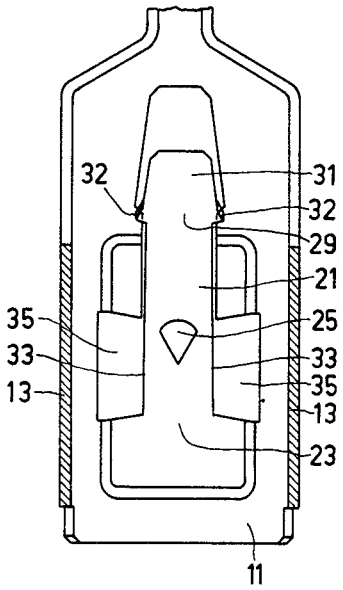
FIG. 4 is partly a plan view and partly a sectional view of the connector shown in FIG. 1.

In order to lock the terminal 5 in the connector, a resilient tongue 21 is released from the base 11 by stamping, said tongue extending rearwardly from its root 23 at the front of the base (see also FIGS. 3 and 4). The tongue 21 comprises a projection 25 which is formed by local deformation of the material of the tongue in the direction of the interior of the receptacle portion 1. This projection is capable of cooperating with a cut-out 27 in the form of a round hole formed in the terminal 5. When the terminal 5 is inserted into the receptacle portion 1 from the front, it presses the resilient tongue 21 downwards until the cut-out 27 has passed the projection 25.

The tongue 21 subsequently veers upward again and the projection 25 engages the cut-out 27, so that the terminal 5 can no longer be withdrawn. In order to enable the release of the lock between the connector and the terminal when desired, the rearmost end portion 29 of the tongue 21 is bent upward, so that it projects above the side walls 13, its end 31 being bent so as to be parallel to the base 11 so that it can act as a control member. The tongue 21 can be pressed downward by pressing this end with a finger, so that the projection 25 is released from the cut-out 27. At the rear end portion 29 of the tongue 21 there are provided two lateral projections 32 which abut against the base 11 if the tongue 21 is pressed down too far. Consequently, the tongue 21 cannot be bent so far that is is damaged.

At the area of the side edges 33 of the resilient tongue 21 first tags are released from the base 11 by stamping, said first tags being completely removed in the present embodiment so that an opening 35 is formed on both sides of the tongue. Consequently, the tags cannot impede the free movement of the tongue 21 and the terminal 5 cannot collide with the tags when it is inserted. This could alternatively be achieved by bending the tags slightly downward, so that their free edges facing the tongue 21 are also removed from the immediate vicinity of the tongue. The complete removal of the tags, however, is safer because accidental bending upwards during use of the connector is thus prevented.

The embodiment shown in FIGS. 5 to 8 is substantially similar to that shown in FIGS. 1 to 4; corresponding parts are denoted by the same reference numerals, but with indices.

The receptacle portion 1' of the connector shown in FIGS. 5 to 8 serves to receive a terminal 5' having a width which is smaller than that of the terminal 5, for example, 3 mm. Consequently, the second embodiment exhibits two differences with respect to the first embodiment shown in FIGS. 1 to 4. First of all, the first tags 37 stamped from the base 11' at the area of the side edges 33' of the resilient tongue 21' are cut loose only on three sides, so that their ends which are remote from the side edges 33' are still connected to the base. Subsequently, the first tags 37 are turned upwards from the base 11' so that they extend approximately parallel to the side walls 13', thus forming an opening 35' again on both sides of the tongue 21'. The distance between the two upward bent first tags 37 is substantially equal to the width of the terminal 5', the width of the space for the terminal in the receptacle portion 1' thus being bounded by these tags. Like in the first embodiment, the height of this space is bounded by the base 11' at the bottom and by the inwardly bending arcuate strips 19' at the top.

The second difference with respect to the first embodiment consists in that two second tags 39 are released from the front end of the base 11' which extends beyond the side walls 13'. The second tags 39 are turned upward like the first tags 37, so that they extend approximately parallel to the side walls 13'. The distance between the second tags 39 is substantially equal to the distance between the first tags 37 and hence also to the width of the terminal 5'. The second tags 39 are not strictly necessary for adaptation of the connector to the smaller width of the terminal 5'. However, they offer the advantage that they guide the terminal 5' in the correct direction immediately upon insertion, with the result that the terminal cannot reach the first tags 37 in an oblique position, so that damaging is prevented.

With the exception of the two described differences, both described embodiments are completely identical so that they can be manufactured substantially by means of the same tool. For completion of the manufacture of the connector only a simple finishing operation is required. For the first embodiment, this operation consists of the removal of the first tags by stamping. For the second embodiment it consists of the turning upward of the first tags and, if included the second tags.

What is claimed is:

1. An electrical connector including a receptacle portion formed from sheet material for receiving an electrical terminal, said receptacle portion comprising a base, a pair of upstanding side walls terminating in end portions turned inwardly toward the base for engaging said terminal, and a resilient tongue rising from the base toward said end portions and extending rearwardly from a front portion of the connector into which the terminal is received, said tongue including an upwardly extending projection for cooperating with an opening in the terminal for securing said terminal in the connector, wherein the improvement comprises a first pair of removable tags forced out of the base below the tongue, each tag extending upwardly between the tongue and a respective one of the side walls, said tags being substantially parallel to the side walls, being spaced apart by a first distance approximately equal to the width of a first size terminal to be received in the connector, and extending to a height sufficient to prevent insertion of a terminal wider than said first distance, and said side walls being spaced apart by a distance approximately equal to the width of a second size terminal to be received in the connector.

2. An electrical connector as in claim 1 where said tags are removed, thereby enabling acceptance by the connector of said second size terminal.

3. An electrical connector as in claim 1 including a second pair of tags extending upwardly from the base in front of the first pair of tags and in alignment with the first pair of tags.

* * * * *